US009613571B2

(12) United States Patent
Gotoh et al.

(10) Patent No.: US 9,613,571 B2
(45) Date of Patent: Apr. 4, 2017

(54) DISPLAY DEVICE, METHOD FOR DRIVING DISPLAY DEVICE, AND ELECTRONIC APPARATUS

(71) Applicant: Japan Display Inc., Tokyo (JP)

(72) Inventors: Fumitaka Gotoh, Tokyo (JP); Tsutomu Harada, Tokyo (JP); Naoyuki Takasaki, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 14/505,084

(22) Filed: Oct. 2, 2014

(65) Prior Publication Data

US 2015/0109359 A1 Apr. 23, 2015

(30) Foreign Application Priority Data

Oct. 22, 2013 (JP) ..... 2013-219689

(51) Int. Cl.

| | |
|---|---|
| ***G09G 3/34*** | (2006.01) |
| ***G09G 3/36*** | (2006.01) |
| ***G09G 5/04*** | (2006.01) |

(52) U.S. Cl.

CPC ..... *G09G 3/3406* (2013.01); *G09G 3/3648* (2013.01); *G09G 5/04* (2013.01); *G09G 2300/0452* (2013.01); *G09G 2320/0242* (2013.01); *G09G 2320/0646* (2013.01); *G09G 2320/0666* (2013.01); *G09G 2330/023* (2013.01); *G09G 2380/10* (2013.01)

(58) Field of Classification Search

CPC ..... G09G 3/342; G09G 3/3413; G09G 3/3406
See application file for complete search history.

(56) References Cited

U.S. PATENT DOCUMENTS

2005/0184998 A1* 8/2005 Yang ..... G09G 3/3406 345/589
2009/0160747 A1* 6/2009 Morisue ..... G09G 3/3406 345/88

FOREIGN PATENT DOCUMENTS

| | | |
|---|---|---|
| JP | 2004-191950 A | 7/2004 |
| JP | 2005-242300 | 9/2005 |
| JP | 2009-086054 A | 4/2009 |

OTHER PUBLICATIONS

Japanese Office Action issued Feb. 23, 2016 for corresponding Japanese Application No. 2013-219689.

* cited by examiner

*Primary Examiner* — Michael Faragalla
*Assistant Examiner* — Chayce Bibbee
(74) *Attorney, Agent, or Firm* — Michael Best & Friedrich LLP

(57) ABSTRACT

A display device includes: an image display unit in an image display region, the image display unit including a plurality of main pixels each including sub-pixels; a light source portion that irradiates the image display region; a signal correction unit that calculates saturation and value of the main pixels based on first color information to be displayed on a predetermined pixel, the first color information being obtained based on an input video signal, and generates second color information by correcting the first color information based on the calculated saturation and value; a signal generation unit that calculates the saturation and the value of the main pixels based on the second color information, and generates a signal for determining light source luminance of the light source based on the calculated saturation and value; and a light source control unit that controls luminance of the light source based on the signal.

11 Claims, 15 Drawing Sheets

DISPLAY DEVICE, METHOD FOR DRIVING DISPLAY DEVICE, AND ELECTRONIC APPARATUS

CROSS-REFERENCE TO RELATED APPLICATIONS

This application claims priority from Japanese Application No. 2013-219689, filed on Oct. 22, 2013, the contents of which are incorporated by reference herein in its entirety.

BACKGROUND

1. Technical Field

The present disclosure relates to a display device including an image display unit, a method for driving the display device, and an electronic apparatus.

2. Description of the Related Art

In recent years, a red-green-blue-white (RGBW)-type image display technique has attracted attention that uses a white (W) pixel in addition to a red (R) pixel, a green (G) pixel, and a blue (B) pixel used in a red-green-blue (RGB)-type image display technique (for example, refer to Japanese Patent Application Laid-open Publication No. 2005-242300). In the RGBW-type image display technique, white is more highlighted than a conventional technique by using the white (W) pixel, so that a high-saturation image can be displayed with low power consumption.

In a display device mounted to a mobile device, it is effective to reduce luminance of a backlight to reduce the entire power consumption of device. However, in a display device that displays a high-saturation image such as an RGBW-type display device in the related art, when the luminance of the backlight is reduced, display quality is remarkably deteriorated to a degree that can be visually recognized. Accordingly, it has been difficult to reduce the entire power consumption of the display device by reducing the luminance of the backlight.

In the conventional RGBW-type display device, expansion coefficients $\alpha$ are the same between colors the saturation of which is the same regardless of a hue. Due to this, regarding the conventional display device, it has been examined to reduce the power consumption by partitioning a region of the hue and changing a threshold for each color. In this case, however, the expansion coefficient $\alpha$ is significantly changed for color more or less deviated from the region of the hue.

For the foregoing reasons, there is a need for a display device that can reduce the entire power consumption of the device by reducing light source luminance even when a high-saturation image is displayed, a method for driving the display device, and an electronic apparatus.

SUMMARY

According to an aspect, a display device includes: an image display unit that includes a plurality of main pixels each including sub-pixels that are a red pixel, a green pixel, and a blue pixel in an image display region; a light source that irradiates the image display region with illumination light; a signal correction unit that calculates saturation (also called as chroma) and value (also called as lightness, brightness, luminance) of the main pixels based on first color information to be displayed on a predetermined pixel, the first color information being obtained based on an input video signal, and generates second color information by correcting the first color information based on the calculated saturation and value; a signal generation unit that calculates the saturation and the value of the main pixels based on the second color information, and generates a signal for determining light source luminance of the light source based on the calculated saturation and value; and a light source control unit that controls luminance of the light source based on the light source luminance determined by the signal generation unit.

According to another aspect, a method for driving a display device, the method includes: calculating saturation and value of a main pixel including sub-pixels that are a red pixel, a green pixel, and a blue pixel in an image display region based on first color information to be displayed on the main pixel, the first color information being obtained based on an input video signal; generating second color information by correcting the first color information based on the saturation and the value calculated at the calculating; determining light source luminance of a light source that irradiates the image display region with irradiation light based on the saturation and value of the main pixel calculated based on the second color information calculated at the generating; and controlling light source luminance of the light source to be the light source luminance determined at the determining.

According to another aspect, an electronic apparatus includes: a display device including an image display unit that includes a plurality of main pixels each including sub-pixels that are a red pixel, a green pixel, and a blue pixel in an image display region; a light source that irradiates the image display region with illumination light; a signal correction unit that calculates saturation and value of the main pixels based on first color information to be displayed on a predetermined pixel, the first color information being obtained based on an input video signal, and generates second color information by correcting the first color information based on the calculated saturation and value; a signal generation unit that calculates the saturation and the value of the main pixels based on the second color information, and generates a signal for determining light source luminance of the light source based on the calculated saturation and value; and a light source control unit that controls luminance of the light source based on the light source luminance determined by the signal generation unit; and a controller that controls the controller.

DETAILED DESCRIPTION

The following describes an embodiment of the present invention in detail with reference to the attached drawings. In the embodiment, a liquid crystal display device is exemplified as a display device. However, the present invention can be applied to various display devices, not limited to the liquid crystal display device.

Figure 1:
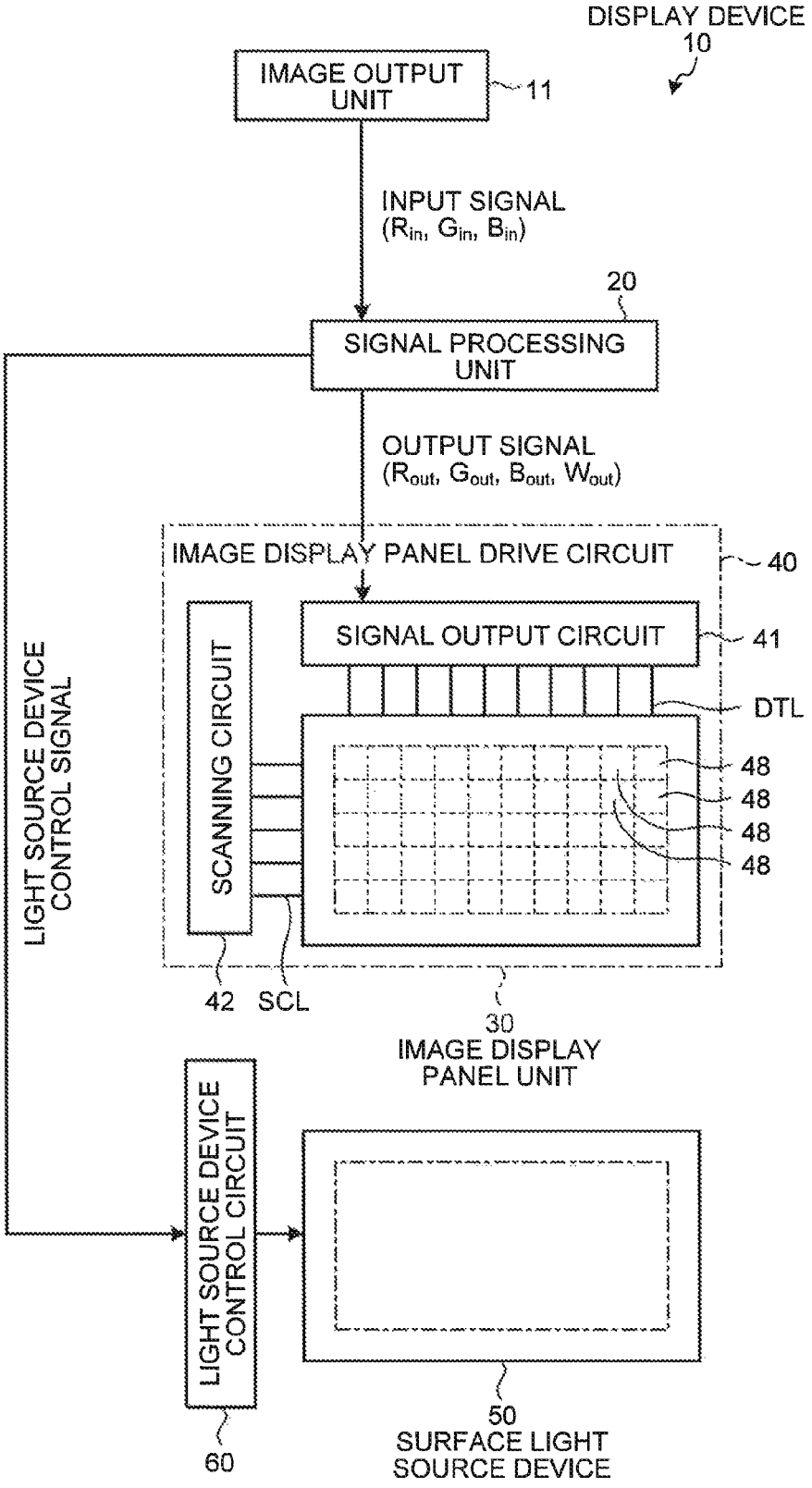
FIG. 1 is a functional block diagram illustrating a configuration example of a liquid crystal display device according to an embodiment of the present disclosure.
Figure 2:
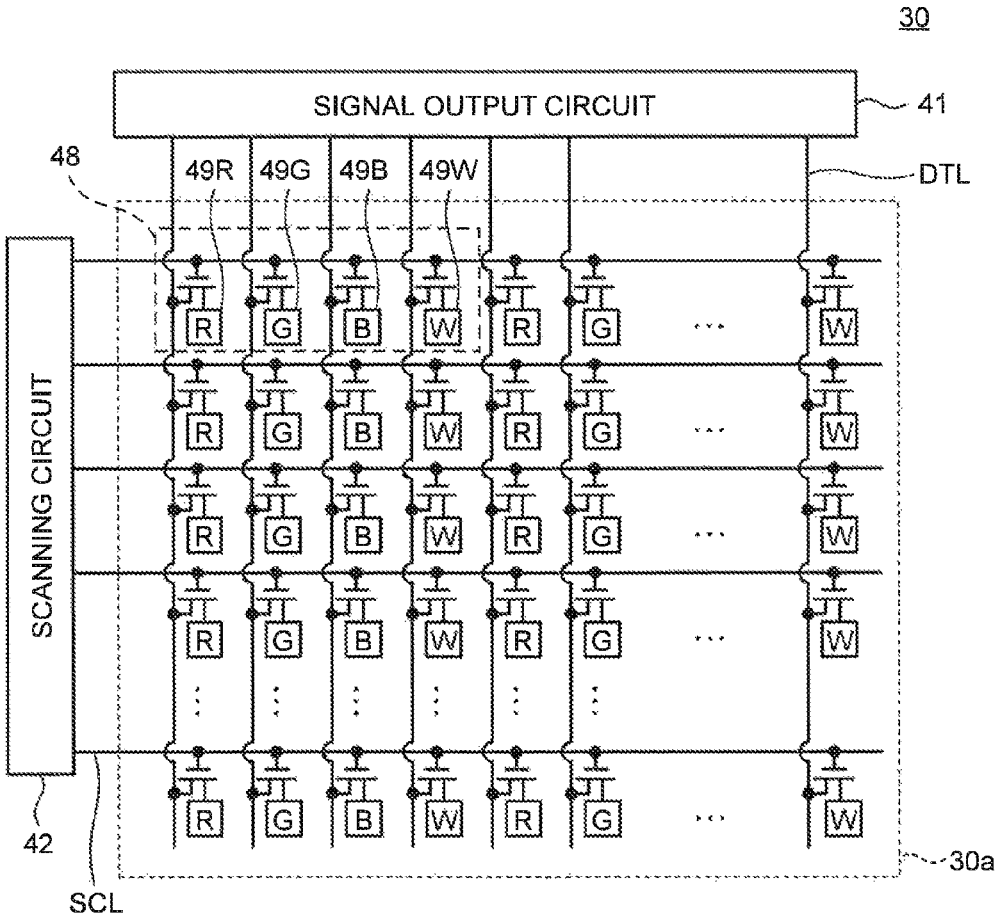
FIG. 2 is a wiring diagram of an image display panel unit in the liquid crystal display device illustrated in FIG. 1.

FIG. 1 is a functional block diagram illustrating a configuration example of the liquid crystal display device according to the embodiment. FIG. 2 is a wiring diagram of an image display panel unit in the liquid crystal display device illustrated in FIG. 1.

As illustrated in FIG. 1, a liquid crystal display device 10 (hereinafter, simply referred to as a "display device 10" in some cases) according to the embodiment includes a signal processing unit 20 that receives an input signal (RGB data) from an image output unit 11 and executes predetermined data conversion processing to output the signal, an image display panel unit 30 that displays an image based on the output signal output from the signal processing unit 20, an image display device drive circuit 40 that controls a display operation of the image display panel unit 30, a surface light source device 50 that irradiates an image display region 30*a* (not illustrated in FIG. 1, refer to FIG. 2) of the image display panel unit 30 with white light in a plane shape from the back surface of the image display panel unit 30, and a light source device control circuit (light source control unit) 60 that controls an operation of the surface light source device 50. The configuration of the display device 10 is similar to that of a display device assembly disclosed in Japanese Patent Application Laid-open Publication No. 2011-154323 (JP-A-2011-154323). Various modifications disclosed in JP-A-2011-154323 can be applied to the display device 10.

The signal processing unit 20 is an arithmetic processing unit that controls operations of the image display panel unit 30 and the surface light source device 50. The signal processing unit 20 is electrically coupled to the image display device drive circuit 40 that drives the image display panel unit 30 and the light source device control circuit 60 that drives the surface light source device 50. The signal processing unit 20 executes data processing of the input signal (RGB data) that is received from the outside, outputs an output signal to the image display device drive circuit 40, and generates and outputs a light source device control signal to the light source device control circuit 60.

The signal processing unit 20 performs predetermined color conversion processing on input signals (Rin, Gin, Bin) serving as RGB data represented by an energy ratio among R (red), G (green), and B (blue). The signal processing unit 20 then generates output signals (Rout, Gout, Bout, Wout) represented by an energy ratio among R (red), G (green), B (blue), and W (white), to which the fourth color W (white) is added. The signal processing unit 20 then outputs the generated output signals (Rout, Gout, Bout, Wout) to the image display device drive circuit 40, and outputs the light source device control signal to the light source device control circuit 60. In the embodiment, an RGBW-type display device is described in which the signal processing unit 20 generates RGBW output signals. However, the present invention can also be applied to a display device in which the signal processing unit 20 generates RGB-type output signals.

Each of the input signals (Rin, Gin, Bin) is the RGB data indicating a specific color in the standard color gamut. Various standards applied to image display can be used as the standard color gamut. Examples thereof include, but are not limited to, the color gamut of the sRGB standard, the color gamut of the Adobe (registered trademark) RGB standard, and the color gamut of the NTSC standard. The sRGB standard is defined by the International Electrotechnical Commission (IEC). The Adobe (registered trademark) RGB standard is defined by Adobe Systems Incorporated. The NTSC standard is defined by the National Television System Committee.

As illustrated in FIG. 2, the image display panel unit 30 is a color liquid crystal display device including the image display region 30*a*. In the image display region 30*a*, a pixel 48 including a first sub-pixel 49R for displaying a first color (red), a second sub-pixel 49G for displaying a second color (green), a third sub-pixel 49B for displaying a third color (blue), and a fourth sub-pixel 49W for displaying a fourth color (white) is arranged in a two-dimensional matrix. A first color filter for transmitting light of the first color (red) is arranged between the first sub-pixel 49R and a display surface of the image display panel unit 30, a second color filter for transmitting light of the second color (green) is arranged between the second sub-pixel 49G and the display surface of the image display panel unit 30, and a third color filter for transmitting light of the third color (blue) is arranged between the third sub-pixel 49B and the display surface of the image display panel unit 30. A transparent resin layer for transmitting all colors is arranged between the fourth sub-pixel 49W and the display surface of the image display panel unit 30. There may be nothing between the fourth sub-pixel 49W and the display surface of the image display panel unit 30.

In the example illustrated in FIG. 2, the first sub-pixel 49R, the second sub-pixel 49G, the third sub-pixel 49B, and the fourth sub-pixel 49W are arranged similarly to a stripe array in the image display panel unit 30. The configuration and arrangement of sub-pixels included in one pixel are not specifically limited. For example, in the image display panel unit 30, the first sub-pixel 49R, the second sub-pixel 49G, the third sub-pixel 49B, and the fourth sub-pixel 49W may be arranged similarly to a diagonal array (mosaic array). Alternatively, for example, they may be arranged similarly to a delta array (triangle array), a rectangle array, or the like. Generally, the arrangement similar to a stripe array is suitable for displaying data and character strings in a personal computer and the like. In contrast, the arrangement similar to a mosaic array is suitable for displaying a natural image in a video camera recorder, a digital still camera, and the like.

The image display device drive circuit 40 includes a signal output circuit 41 (signal output unit) and a scanning circuit 42. The signal output circuit 41 is, as illustrated in FIG. 2, electrically coupled to sub-pixels in pixels 48 of the image display panel unit 30 via wiring diode-transistor logic (DTL). The signal output circuit 41 outputs a driving voltage to be applied to a liquid crystal included in each sub-pixel based on the output signals (Rout, Gout, Bout, Wout) output from the signal processing unit 20, and controls transmittance of light emitted from the surface light source device 50 for each pixel. The scanning circuit 42 is electrically coupled, via wiring switch control logic (SCL), to a switching element for controlling an operation of each sub-pixel in each pixel 48 of the image display panel unit 30. The scanning circuit 42 sequentially outputs scanning signals to a plurality of pieces of wiring SCL, and applies each of the scanning signals to the switching element of the sub-pixel in each pixel 48 to turn ON the switching element. The signal output circuit 41 applies the driving voltage to the liquid crystal included in the sub-pixel to which the scanning signal from the scanning circuit 42 is applied. In this way, an image is displayed on the entire image display region 30*a* of the image display panel unit 30.

The surface light source device 50 is a backlight including various light sources and arranged on the back surface of the image display panel unit 30. The surface light source device 50 illuminates the image display panel unit 30 by emitting light from the light source to the image display panel unit 30.

The light source device control circuit 60 controls lighting quantity and/or a load of the light source in the surface light source device 50 based on the light source device control signal output from the signal processing unit 20, and adjusts an amount of light and intensity of light emitted from the surface light source device 50 to the image display panel unit 30. The light source device control circuit 60 can also control the light source and the intensity of light by controlling the lighting quantity and/or the load of part of the light sources.

Figure 3:
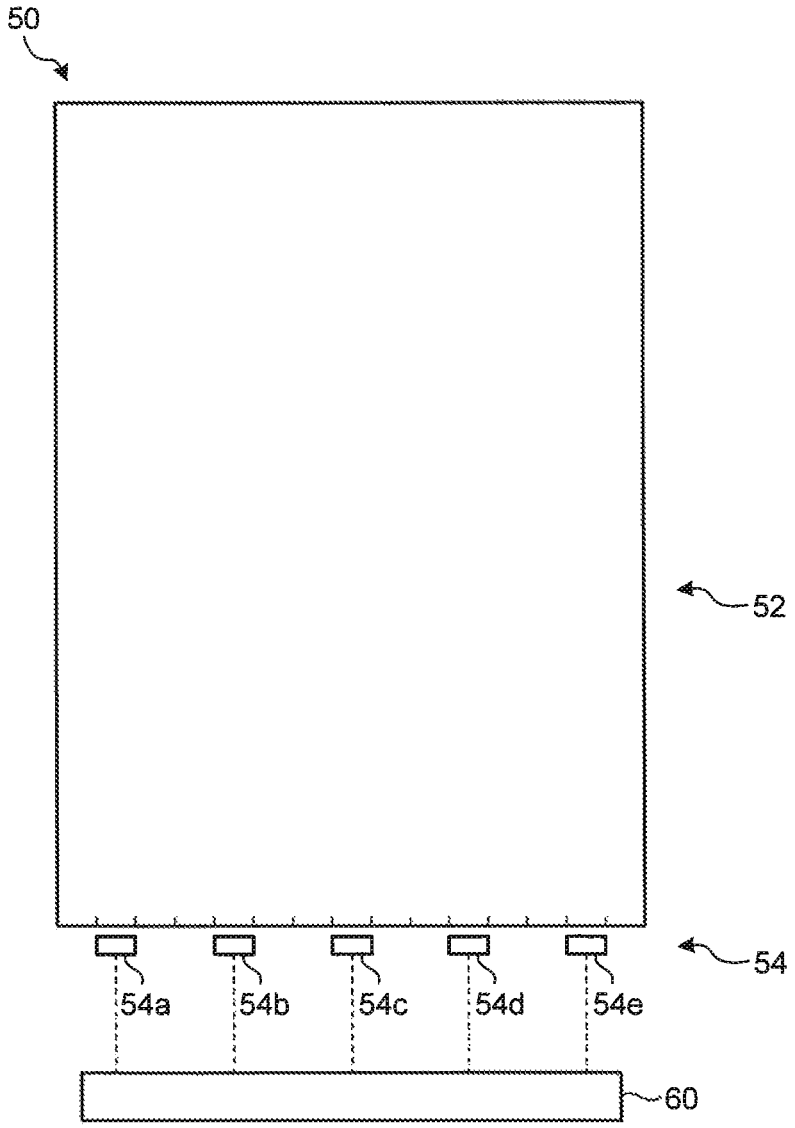
FIG. 3 is a schematic diagram of a surface light source device according to the embodiment of the present disclosure.

FIG. 3 is a schematic diagram of the surface light source device 50 according to the embodiment. As illustrated in FIG. 3, the surface light source device 50 includes a light guide plate 52 and a light source portion 54 arranged in the vicinity of an end face of the light guide plate 52. The light source portion 54 includes a plurality of light sources arranged at a predetermined interval along one direction. FIG. 3 illustrates that five light-emitting diodes (LEDs) 54*a* to 54*e* serving as point light sources are formed. An optical sheet and the like (not illustrated) are arranged on an emitting surface side of the light guide plate 52, a reflective sheet (not illustrated) is arranged on a surface opposed to the emitting surface of the light guide plate 52. The five LEDs 54*a* to 54*e* are electrically coupled to the light source device control circuit 60. The light guide plate 52 guides the light emitted from the five LEDs 54*a* to 54*e* to the inside via the end face, and emits the light guided to the inside toward the image display panel unit 30 from a principal plane. In the example of the embodiment, the light source portion 54 includes the five LEDs 54*a* to 54*e*. Alternatively, the number of LEDs included in the light source portion 54 may be appropriately modified. The plurality of light sources of the light source portion 54 are not limited to the LEDs 54*a* to 54*e*, and may be configured using various point light sources and line light sources.

Figure 4A:
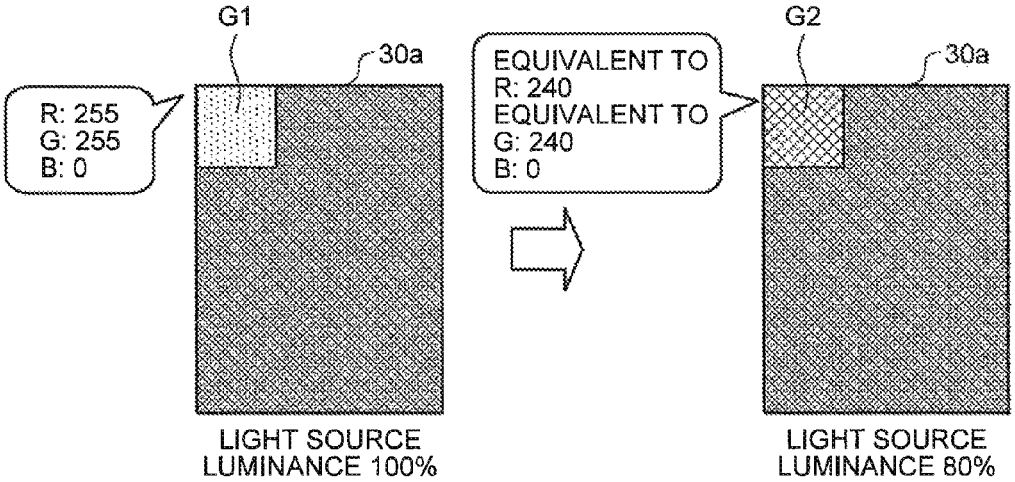
FIG. 4A is an explanatory diagram of a method for driving a display device according to the embodiment of the present disclosure.
Figure 4B:
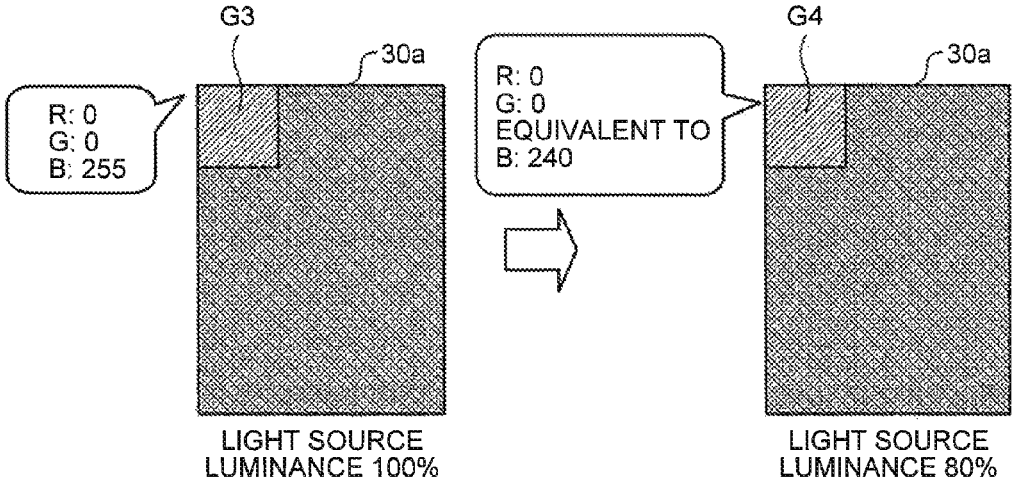
FIG. 4B is an explanatory diagram of the method for driving the display device according to the embodiment of the present disclosure.
Figure 5:
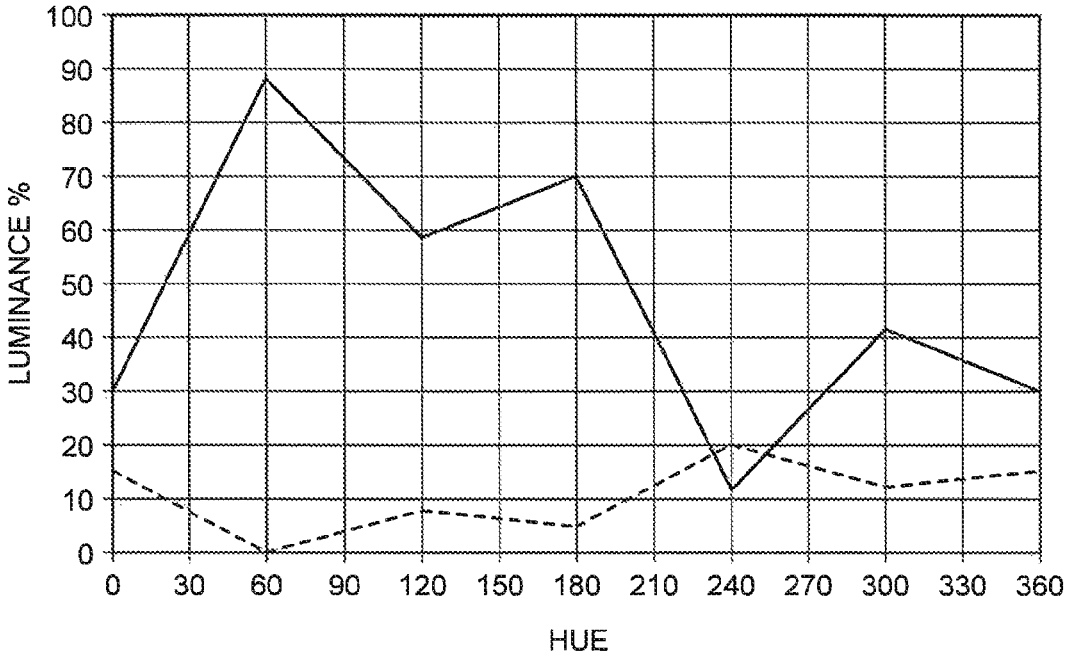
FIG. 5 is a diagram illustrating a relation between value and a hue in the method for driving the display device according to the embodiment of the present disclosure.

Next, the following describes a concept of a method for driving a display device for the display device 10 according to the embodiment with reference to FIG. 4A, FIG. 4B, and FIG. 5. FIG. 4A and FIG. 4B are explanatory diagrams of the method for driving the display device according to the embodiment.

In the example illustrated in FIG. 4A, a yellow high-saturation high-value image G1 is displayed in the image display region 30*a*, in which image data of the first sub-pixel 49R for displaying the first color (red) and the second sub-pixel 49G for displaying the second color (green) is as follows: (R: 255, G: 255). In this case, even when light source luminance of the surface light source device 50 is reduced from 100% to 80% to reduce power consumption, the image data (R: 255, G: 255) is not changed. On the other hand, along with the reduction in the light source luminance, the image data of the high-saturation high-value image G1 becomes equivalent to (R: 240, G: 240). Accordingly, the high-saturation high-value image G1 is caused to be a yellow high-saturation intermediate-value image G2 the display quality of which is deteriorated to a degree that can be visually recognized.

On the other hand, in the example illustrated in FIG. 4B, a blue high-saturation low-value image G3 is displayed in the image display region 30*a*, in which the third sub-pixel 49B for displaying the third color (blue) is as follows: (B: 255). Regarding the high-saturation low-value image G3, even when the light source luminance of the surface light source device 50 is reduced from 100% to 80% to reduce the power consumption, the image data (B: 255) is not changed. Along with the reduction in the light source luminance, the image data of the high-saturation low-value image G3 becomes equivalent to (B: 240). However, a change in the value thereof is small, and the high-saturation low-value image G3 is caused to be a high-saturation low-value image G4 the display quality of which is hardly deteriorated to a degree that can be visually recognized.

FIG. 5 is a diagram illustrating a relation between the value and the hue. In FIG. 5, the horizontal axis represents a numerical value of the hue, and the vertical axis represents a numerical value of the value. The solid line in FIG. 5 indicates the value corresponding to a numerical value of the hue, and the dotted line in FIG. 5 indicates the maximum reduction amount of the light source luminance. Regarding the dotted line in FIG. 5, the maximum reduction amount of the light source luminance is defined as 20%, for example.

As indicated by the solid line in FIG. 5, in the high-saturation image, the value of a red image the hue of which is substantially 0 and 360 is 30%, the value of a yellow image the hue of which is substantially 60 is 88%, the value of a green image the hue of which is substantially 120 is 60%, and the value of a blue image the hue of which is substantially 240 is 10%. As indicated by the solid line in FIG. 5, it can be found from the value for each hue that value change is large for a high-value hue and the value change is small for a low-value hue even when the reduction amounts of the light source value are the same. In an inverse relation indicated by the solid line in FIG. 5, the change amount of the value of the displayed image is small even when the light source value is reduced, which represents a degree to which the light source value indicated by the dotted line in FIG. 5 can be reduced. The degree to which the light source value can be reduced can be obtained by calculating the value without calculating the hue.

Accordingly, in the embodiment, the saturation and the value are calculated for the image displayed in the image display region 30*a*, and the reduction amount of the light source value is set based on the calculated saturation and the value of the image. Due to this, the entire power consumption of the device can be reduced by reducing the light source value even in the display device that can display a high-saturation image.

Figure 6A:
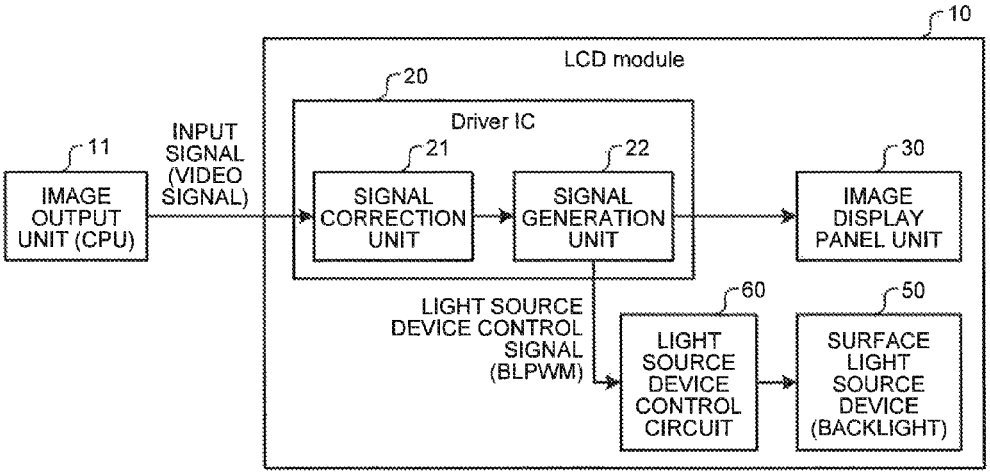
FIG. 6A is an explanatory diagram of the method for driving the display device according to the embodiment of the present disclosure.
Figure 6B:
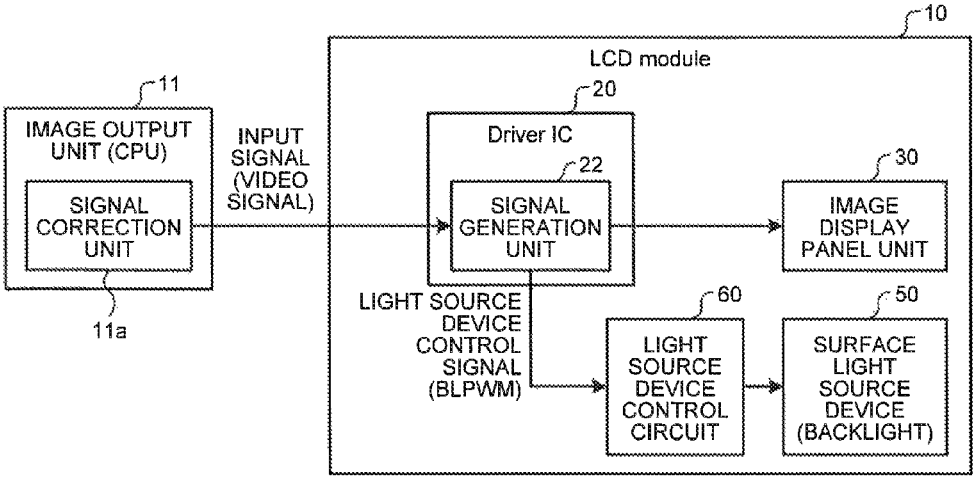
FIG. 6B is an explanatory diagram of the method for driving the display device according to the embodiment of the present disclosure.

Next, the following describes signal processing in the display device 10 according to the embodiment in detail with reference to FIG. 6A and FIG. 6B. FIG. 6A and FIG. 6B are functional block diagrams illustrating the signal processing in the display device 10 according to the embodiment.

In the example illustrated in FIG. 6A, the signal processing unit 20 includes a signal correction unit 21 and a signal generation unit 22. To the signal correction unit 21, input signals (video signals: Rin, Gin, Bin) are input as video signals (RGB data) from the image output unit (CPU) 11 on the outside of the display device 10. The signal correction unit 21 calculates the saturation and the value of the main pixel 48 based on first color information to be displayed on a predetermined pixel that is obtained based on the input video signals, generates second color information by correcting the first color information based on the calculated saturation and value, calculates the saturation and the value of the main pixel 48 based on the second color information, and corrects the image data of the input signals based on the calculated saturation and value.

Preferably, the signal correction unit 21 calculates the saturation and the value for each of the sub-pixels 49R, 49G, and 49B that are a red pixel (R), a green pixel (G), and a blue pixel (B) of the image display panel unit 30, and corrects the image data of the input signals based on the calculated saturation and value for each of the sub-pixels.

Preferably, the signal correction unit 21 corrects the RGB data of the input signals based on the value obtained by the following expression (1) and the saturation obtained by the following expression (2). Due to this, the image data of the input signals can be more accurately corrected.

$$\text{value}=R\text{in}\times YR+G\text{in}\times YG+B\text{in}\times YB \quad \text{expression (1)}$$

$$\text{saturation}=\text{MAX}(R\text{in},G\text{in},B\text{in})-\text{MIN}(R\text{in},G\text{in},B\text{in}) \quad \text{expression (2)}$$

(in the expression (1) and the expression (2), Rin represents the input signal to the red pixel (R), Gin represents the input signal to the green pixel (G), Bin represents the input signal to the blue pixel (B), YR represents a value ratio of the red pixel (R), YG represents a value ratio of the green pixel (G), and YB represents a value ratio of the blue pixel (B).)

Preferably, the signal correction unit 21 calculates the output signal the light source luminance of which is reduced based on the following expressions (3) to (6). Due to this, the input signals to the sub-pixels are reduced in proportion to the saturation and in inverse proportion to the value, and are output. Accordingly, when the RGBW output signals are created using the calculated output signals, the entire power consumption of the display device 10 can be reduced by reducing the light source luminance.

$$\text{reduction rate}=\text{maximum reduction rate}\times\text{saturation}\times(1/\text{value}) \quad \text{expression (3)}$$

$$R\text{out}=R\text{in}-R\text{in}\times\text{reduction rate} \quad \text{expression (4)}$$

$$G\text{out}=G\text{in}-G\text{in}\times\text{reduction rate} \quad \text{expression (5)}$$

$$B\text{out}=B\text{in}-B\text{in}\times\text{reduction rate} \quad \text{expression (6)}$$

(in the expression (3) to the expression (6), Rin represents the input signal of the red pixel (R), Gin represents the input signal of the green pixel (G), Bin represents the input signal of the blue pixel (B), Rout represents the output signal of the red pixel (R), Gout represents the output signal of the green pixel (G), and Bout represents the output signal of the blue pixel (B).)

In the display device 10 according to the embodiment, depending on a use state of the display device 10, the signal correction unit 21 can switch between a display quality priority mode in which luminous intensity of the light source is prevented from being reduced and a low power mode in which a reduction amount of the luminous intensity of the light source is increased. Accordingly, a battery can be efficiently used especially in a case of using the display device 10 for a portable electronic apparatus.

A light source luminance signal and the input signal are input to the signal generation unit 22 from the signal correction unit 21. The signal generation unit 22 generates the light source luminance signal obtained by determining the luminance of the light source portion 54 based on the saturation and the value calculated for each of the red pixel (R), the green pixel (G), and the blue pixel (B) based on the corrected RGB data corrected by the signal correction unit 21. The signal generation unit 22 generates the light source device control signal (BLPWM) that controls the luminance of the light source based on the light source luminance signal, and outputs the generated light source device control signal to the light source device control circuit 60.

The signal generation unit 22 performs linear conversion as reverse γ correction on the input signals (Rin, Gin, Bin) input from the signal correction unit 21. When the input signals (Rin, Gin, Bin) are the RGB data represented by 8 bits (0 to 255), for example, the signal generation unit 22 normalizes each value of an R component, a G component, and a B component of the RGB data to be a value of 0 to 1.

The signal generation unit 22 generates RGBW data including data of a W (white) component for driving the fourth sub-pixel 49W in the pixel 48 based on colorconverted RGB data (Rout, Gout, Bout) obtained by performing color conversion processing on the normalized RGB data.

When the input signals (Rin, Gin, Bin) and the output signals (Rout, Gout, Bout) are the RGB data represented by 8 bits (0 to 255), for example, the signal generation unit 22 converts the generated RGBW data into 8-bit data similarly to the input signals and the output signals, then executes γ correction processing with a γ value (for example, γ=2.2) of the input signal on which γ correction is performed to generate the output signals (Rout, Gout, Bout, Wout) of the γ-corrected RGBW data.

The signal generation unit 22 calculates the output signal of the first sub-pixel based on the input signal of the first sub-pixel, the expansion coefficient α, and the output signal of the fourth sub-pixel, calculates the output signal of the second sub-pixel based on the input signal of the second sub-pixel, the expansion coefficient α, and the output signal of the fourth sub-pixel, and calculates the output signal of the third sub-pixel based on the input signal of the third sub-pixel, the expansion coefficient α, and the output signal of the fourth sub-pixel. The signal generation unit 22 outputs the calculated output signals of the first sub-pixel, the second sub-pixel, the third sub-pixel, and the fourth sub-pixel to the image display panel unit 30.

In the example illustrated in FIG. 6B, the signal processing unit 22 does not include the signal correction unit 21, and a signal correction unit 11*a* corresponding to the signal correction unit 21 in FIG. 6A is arranged inside the CPU of the image output unit 11. The signal correction unit 11*a* performs processing similar to that of the signal correction unit 21 described above in the image output unit 11. In this way, the display device 10 according to the embodiment corresponds to both of the RGB-type and the RGBW-type, so that the light source luminance can be determined by the signal processing unit 20 of the display device 10 or determined in the image output unit 11 outside the display device 10, based on the saturation and the value of the image of the video signal.

According to the embodiment, the signal processing unit 20 converts the input signals (Rin, Gin, Bin) into the output signals (Rout, Gout, Bout, Wout) to distribute quantity of transmitted light of the surface light source device 50 to the fourth sub-pixel 49W of the pixel 48 based on the W (white) component, so that the light can be transmitted from the fourth sub-pixel 49W the light transmittance of which is the highest. Due to this, transmittance of the entire color filter can be improved, so that quantity of light passing through the color filter can be maintained even when the light output from the surface light source device 50 is reduced, and power consumption of the surface light source device 50 can be reduced while maintaining the value of the image.

The functions of the signal correction unit 21 and the signal generation unit 22 may be implemented by hardware or software, and are not specifically limited. Even if each component of the signal processing unit 20 is configured by hardware, circuits do not need to be physically and independently distinguished from each other, and a plurality of functions may be implemented by a physically single circuit.

The light source device control circuit 60 controls the luminance of the light source portion 54 of the surface light source device 50 based on the light source device control signal input from the signal generation unit 22. Preferably, the light source device control circuit 60 dividedly drives the five LEDs 54*a* to 54*e* arranged as the light source portion 54.

Figure 7:
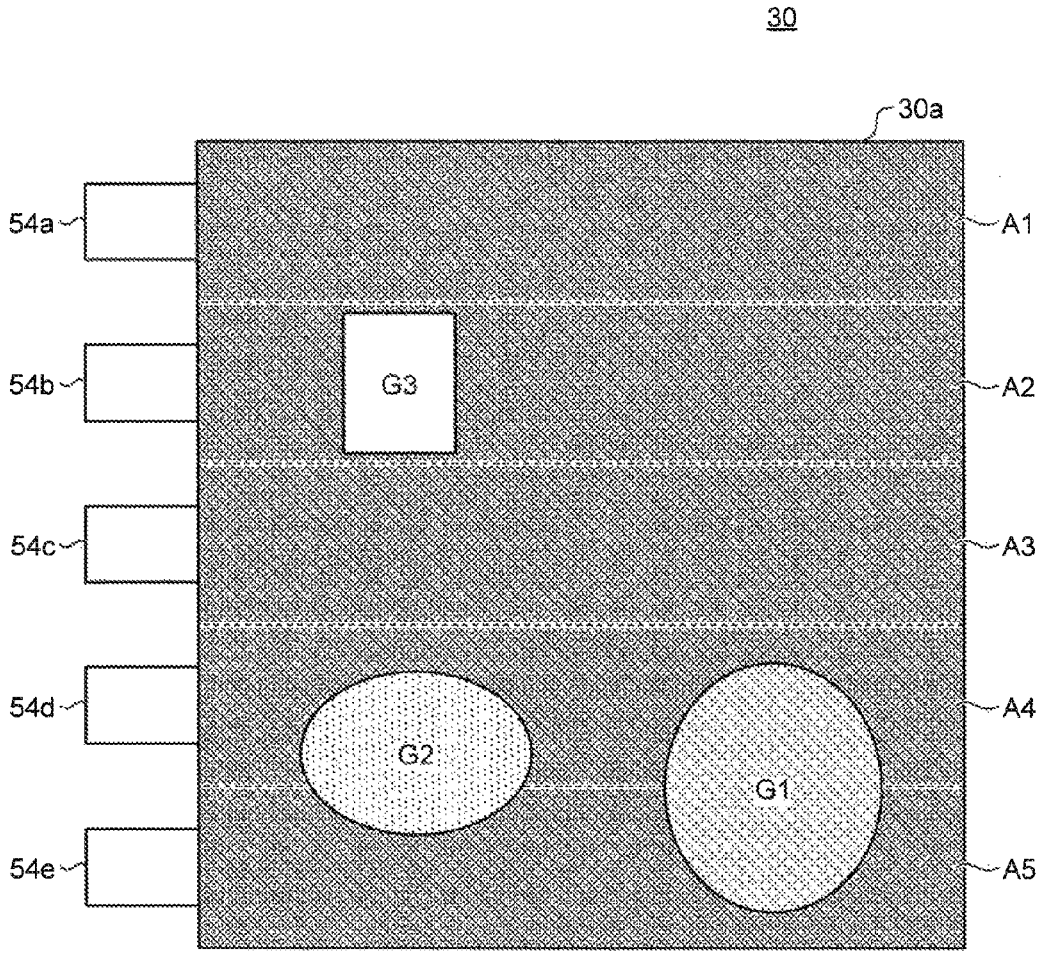
FIG. 7 is an explanatory diagram of divided driving of light-emitting diodes (LEDs) according to the embodiment of the present disclosure.

FIG. 7 is an explanatory diagram of divided driving of the LEDs 54*a* to 54*e*. In the example illustrated in FIG. 7, the five LEDs 54*a* to 54*e* are arranged corresponding to five partial regions A1 to A5 included in the image display region 30*a* of the image display panel unit 30. The LEDs 54*a* to 54*e* are arranged such that the LED 54*a* irradiates the partial region A1 with light, the LED 54*b* irradiates the partial region A2 with light, the LED 54*c* irradiates the partial region A3 with light, the LED 54*d* irradiates the partial region A4 with light, and the LED 54*e* irradiates the partial region A5 with light.

As illustrated in FIG. 7, when the LEDs 54*a* to 54*e* are separately and sequentially driven, the entire power consumption of the display device 10 can be reduced by reducing the light source luminance of the LEDs 54*a* and 54*c* to 54*e* corresponding to the partial regions A1 and A3 that are non-display regions of the image and the partial regions A4 and A5 in which the high-saturation low-value images G1 and G2 are displayed. The display quality of the high-saturation high-value image G3 can be prevented from being deteriorated by increasing the light source luminance of the LED 54*b* corresponding to the partial region A2 in which the high-saturation high-value image G3 is displayed, the saturation and the value of which are equal to or larger than a predetermined value. In this way, by dividedly driving the LEDs 54*a* to 54*e*, the entire power consumption of the display device 10 can be reduced while preventing the display quality of the high-saturation high-value image G3 from being deteriorated even when the high-saturation high-value image G3 is displayed in part of the image display region 30*a*.

Next, the following describes the method for driving the display device according to the embodiment. The method for driving the display device according to the embodiment includes a first step for calculating the saturation and the value of the main pixel 48 based on the first color information to be displayed on the main pixel 48 including the sub-pixels 49 that are the red pixel (R), the green pixel (G), and the blue pixel (B) in the image display region 30*a* obtained based on the input video signals, a second step for generating the second color information by correcting the first color information based on the saturation and the value calculated at the first step, a third step for calculating the saturation and the value of the main pixel 48 based on the second color information calculated at the second step and determining the light source luminance of the light source portion 54 that irradiates the image display region 30*a* with irradiation light based on the calculated saturation and value, and a fourth step for controlling light source value of the light source portion 54 to be the light source value determined at the third step.

Figure 8:
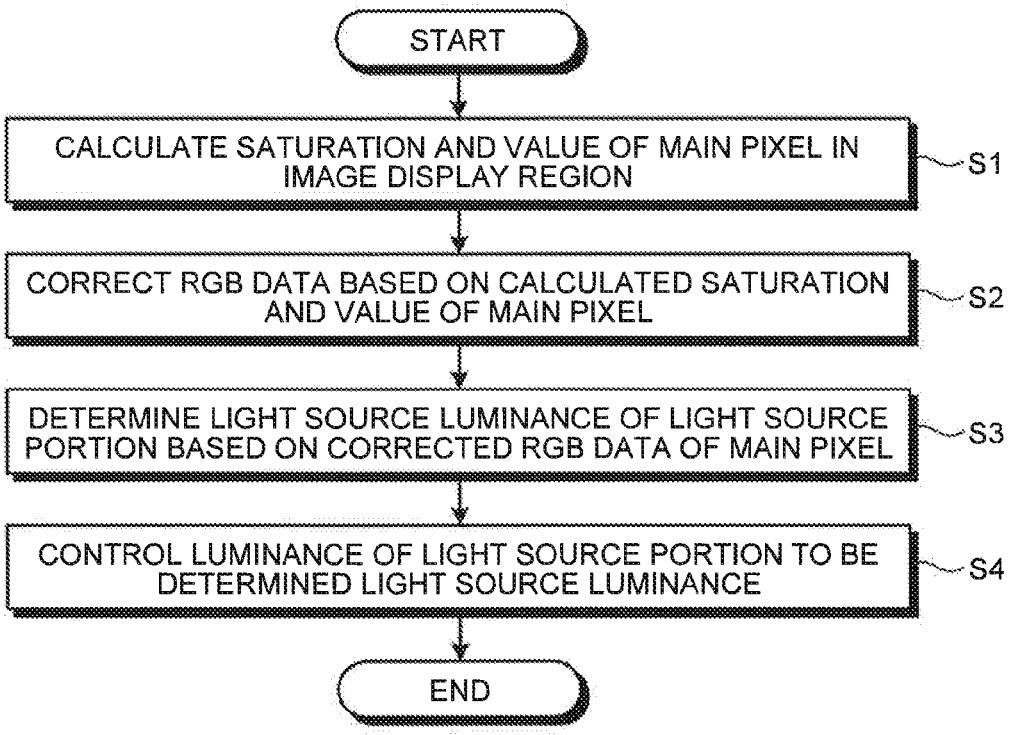
FIG. 8 is a flowchart schematically illustrating the method for driving the display device according to the embodiment of the present disclosure.

FIG. 8 is a flowchart schematically illustrating the method for driving the display device according to the embodiment. First, the signal correction unit 21 calculates the saturation and the value of the main pixels 48 in the image display region 30*a* based on the RGB data input from the image output unit 11 (Step S1). At the first step, the signal correction unit 21 preferably calculates the saturation and the value for each of the sub-pixels 49R, 49G, and 49B of the red pixel (R), the green pixel (G), and the blue pixel (B) of the image display panel unit 30, and determines the value of the light source portion 54 based on the calculated saturation and value for each of the sub-pixels. Accordingly, the RGB data to be input is corrected based on the saturation and the value calculated for each of the red pixel (R), the green pixel (G), and the blue pixel (B), so that the luminance of the light source can be more accurately determined.

Next, if each of the calculated saturation and value of the main pixel is equal to or smaller than a predetermined threshold, the signal correction unit 21 generates another piece of RGB data by correcting the input RGB data (Step S2). If each of the calculated saturation and value of the main pixel exceeds the predetermined threshold, the signal correction unit 21 does not correct the RGB data. Next, based on the input RGB data of the main pixel 48 or the corrected RGB data of the main pixel 48, the signal correction unit 21 generates the light source luminance signal that reduces the light source luminance of the light source portion 54 assuming that the image displayed on the main pixel 48 is the high-saturation low-value image, and outputs the light source luminance signal to the signal generation unit 22 (Step S3).

Subsequently, the signal generation unit 22 generates the light source device control signal based on the input light source luminance signal, and outputs the generated light source control signal to the light source device control circuit 60. The light source device control circuit 60 controls the luminance of the light source portion 54 to be the light source luminance determined by the signal generation unit 22 based on the input light source device control signal (Step S4).

As described above, with the display device according to the embodiment, the signal correction unit 21 controls the light source luminance of the light source based on the saturation and the value of the main pixel 48 in the image display region 30*a*, so that the entire power consumption of the display device 10 can be prevented from being increased while preventing the display quality of the high-saturation high-value image from being deteriorated, even when the high-saturation image is displayed.

Next, the following describes an electronic apparatus including the display device 10 according to the embodiment and a controller for controlling the display device 10 with reference to FIG. 9 to FIG. 22. FIG. 9 to FIG. 22 are diagrams illustrating an example of the electronic apparatus including the display device 10 according to the embodiment. The display device 10 can be applied to electronic apparatuses in various fields such as a television apparatus, a digital camera, a notebook-type personal computer, portable electronic apparatuses including a mobile phone, or a video camera. In other words, the display device 10 can be applied to electronic apparatuses in various fields that display a video signal input from the outside or a video signal generated inside as an image or video.

Application Example 1

Figure 9:
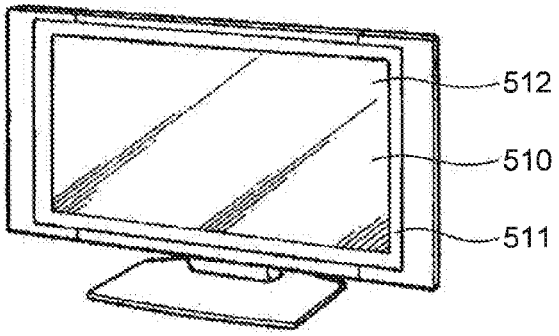
FIG. 9 is a diagram illustrating an example of an electronic apparatus including the display device according to the embodiment of the present disclosure.

The electronic apparatus illustrated in FIG. 9 is a television apparatus to which the display device 10 is applied. The television apparatus includes, for example, a video display screen unit 510 including a front panel 511 and a filter glass 512. The display device 10 is applied to the video display screen unit 510. A screen of the television apparatus has a function of detecting a touch operation, in addition to a function of displaying an image.

Application Example 2

Figure 10:
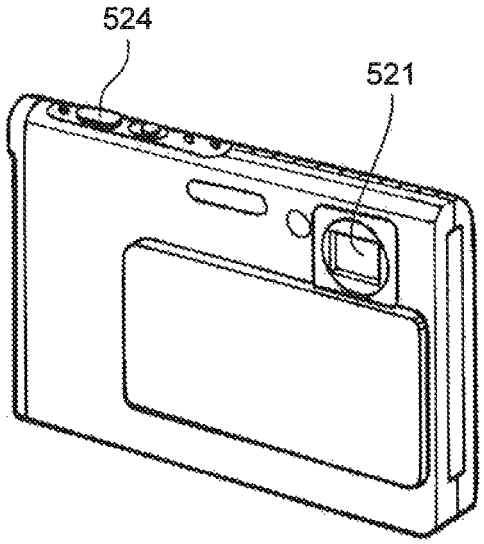
FIG. 10 is a diagram illustrating an example of the electronic apparatus including the display device according to the embodiment of the present disclosure.
Figure 11:
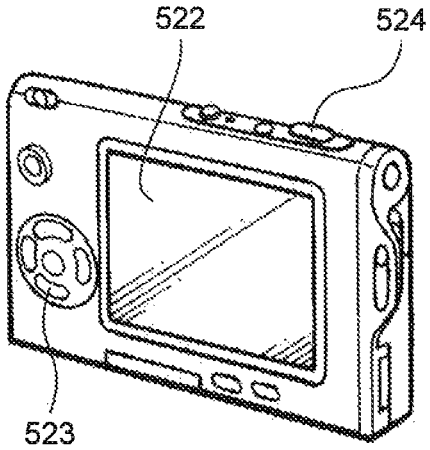
FIG. 11 is a diagram illustrating an example of the electronic apparatus including the display device according to the embodiment of the present disclosure.

The electronic apparatus illustrated in FIG. 10 and FIG. 11 is a digital camera to which the display device 10 is applied. The digital camera includes, for example, a flash light-emitting unit 521, a display unit 522, a menu switch 523, and a shutter button 524. The display device 10 is applied to the display unit 522. Accordingly, the display unit 522 of the digital camera has a function of detecting a touch operation, in addition to a function of displaying an image.

Application Example 3

Figure 12:
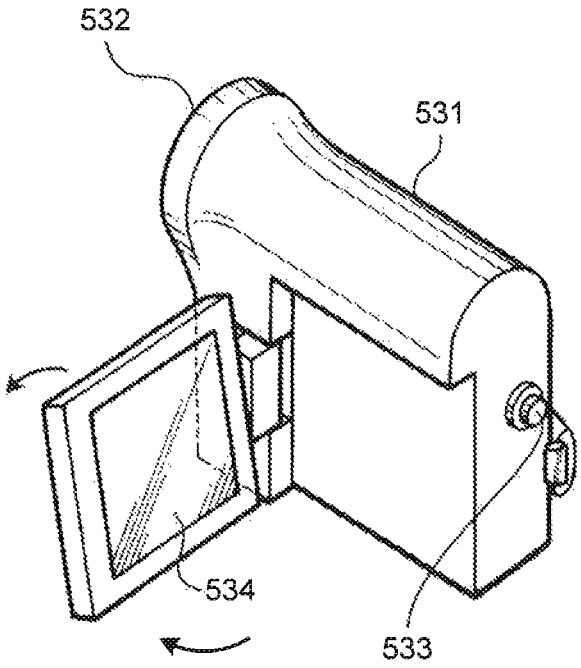
FIG. 12 is a diagram illustrating an example of the electronic apparatus including the display device according to the embodiment of the present disclosure.

The electronic apparatus illustrated in FIG. 12 represents an external appearance of a video camera to which the display device 10 is applied. The video camera includes, for example, a main body 531, a lens 532 for photographing a subject arranged on a front side of the main body 531, a start/stop switch 533 in photographing, and a display unit 534. The display device 10 is applied to the display unit 534. Accordingly, the display unit 534 of the video camera has a function of detecting a touch operation, in addition to a function of displaying an image.

Application Example 4

Figure 13:
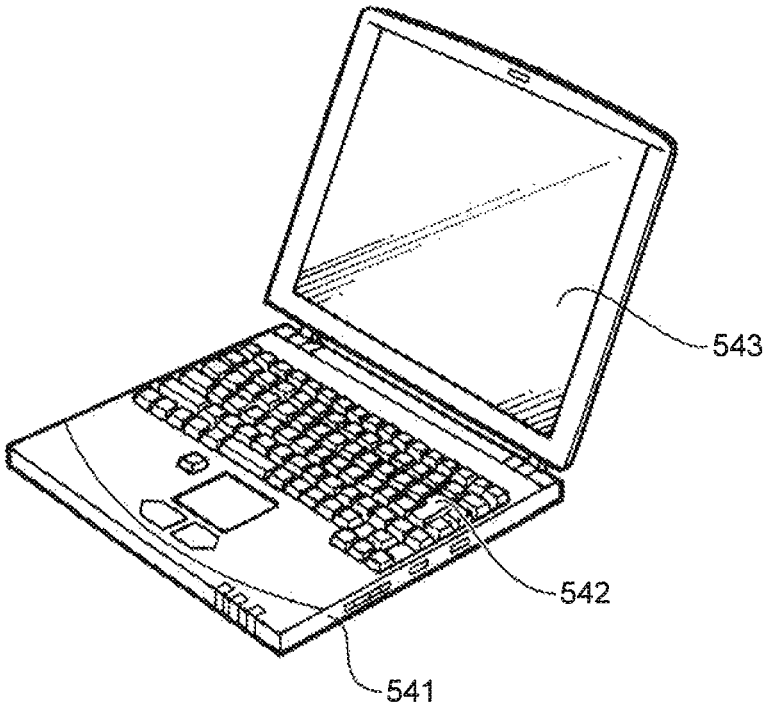
FIG. 13 is a diagram illustrating an example of the electronic apparatus including the display device according to the embodiment of the present disclosure.
Figure 14:
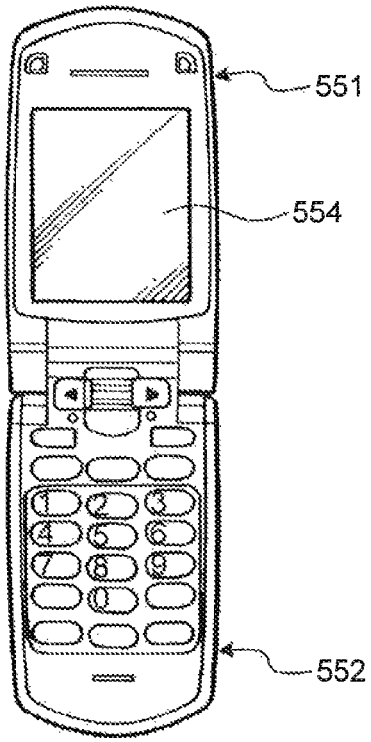
FIG. 14 is a diagram illustrating an example of the electronic apparatus including the display device according to the embodiment of the present disclosure.
Figure 15:
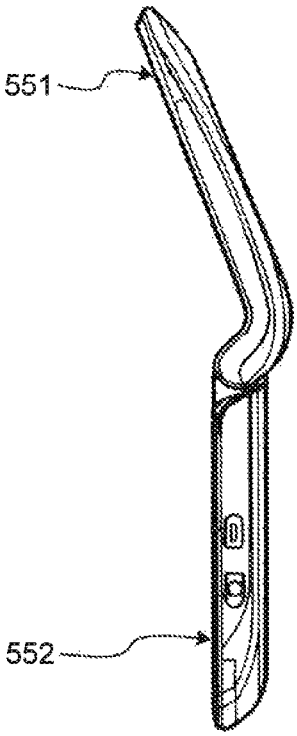
FIG. 15 is a diagram illustrating an example of the electronic apparatus including the display device according to the embodiment of the present disclosure.
Figure 16:
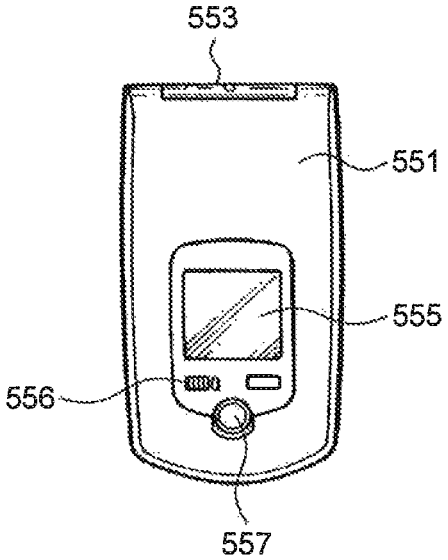
FIG. 16 is a diagram illustrating an example of the electronic apparatus including the display device according to the embodiment of the present disclosure.
Figure 17:
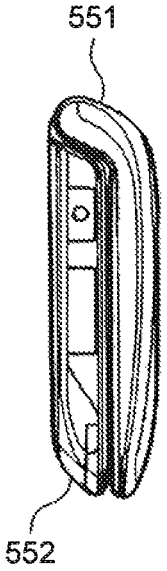
FIG. 17 is a diagram illustrating an example of the electronic apparatus including the display device according to the embodiment of the present disclosure.
Figure 18:
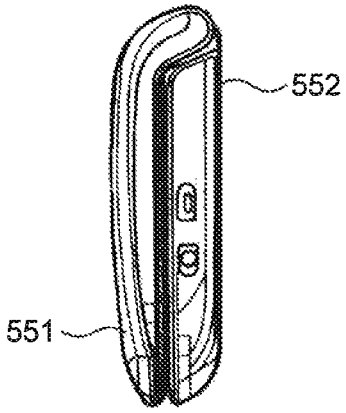
FIG. 18 is a diagram illustrating an example of the electronic apparatus including the display device according to the embodiment of the present disclosure.
Figure 19:
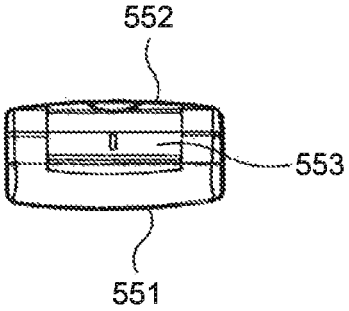
FIG. 19 is a diagram illustrating an example of the electronic apparatus including the display device according to the embodiment of the present disclosure.
Figure 20:
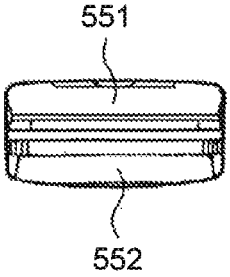
FIG. 20 is a diagram illustrating an example of the electronic apparatus including the display device according to the embodiment of the present disclosure.

The electronic apparatus illustrated in FIG. 13 is a notebook-type personal computer to which the display device 10 is applied. The notebook-type personal computer includes, for example, a main body 541, a keyboard 542 for an input operation of characters and the like, and a display unit 543 for displaying an image. The display device 10 is applied to the display unit 543. Accordingly, the display unit 543 of the notebook-type personal computer has a function of detecting a touch operation, in addition to a function of displaying an image.

Application Example 5

The electronic apparatus illustrated in FIG. 14 to FIG. 20 is a mobile phone to which the display device 10 is applied. The mobile phone is, for example, configured by connecting an upper housing 551 and a lower housing 552 with a connecting part (hinge part) 553, and includes a display unit 554, a sub-display unit 555, a picture light 556, and a camera 557. The display device 10 is mounted as the display unit 554. Accordingly, the display unit 554 of the mobile phone has a function of detecting a touch operation, in addition to a function of displaying an image.

Application Example 6

Figure 21:
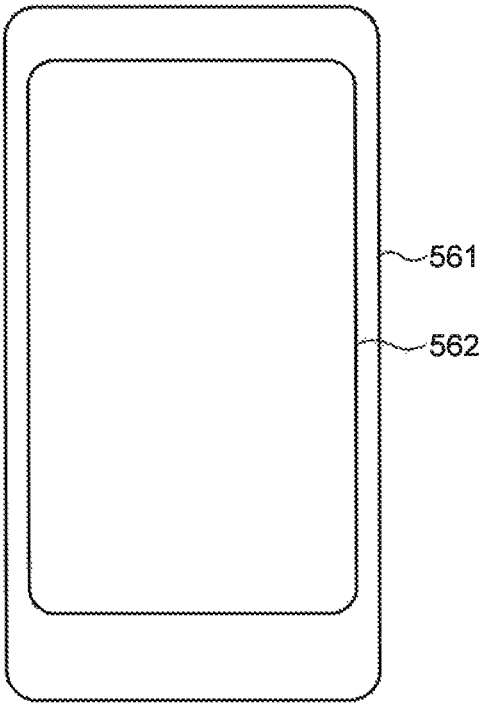
FIG. 21 is a diagram illustrating an example of the electronic apparatus including the display device according to the embodiment of the present disclosure.

The electronic apparatus illustrated in FIG. 21 is a mobile phone or what is called a smartphone, to which the display device 10 is applied. The mobile phone includes, for example, a touch panel 562 arranged on a surface of a substantially rectangular thin-plate housing 561. The touch panel 562 includes touch detection devices 1 and 1A, and the like.

Application Example 7

Figure 22:
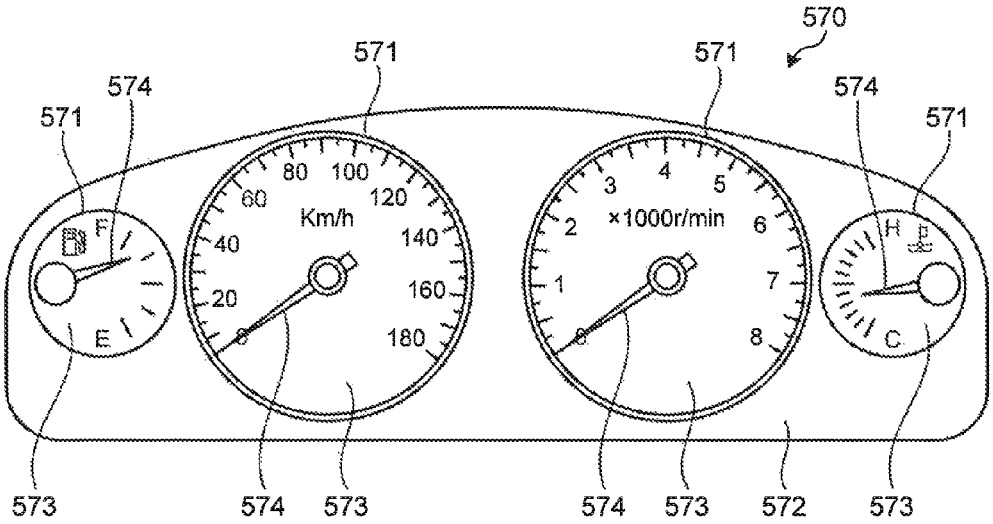
FIG. 22 is a diagram illustrating an example of the electronic apparatus including the display device according to the embodiment of the present disclosure.

The electronic apparatus illustrated in FIG. 22 is a meter unit mounted on a vehicle. A meter unit (electronic apparatus) 570 illustrated in FIG. 22 includes a plurality of liquid crystal display devices 571 such as a fuel gauge, a water-temperature gauge, a speedometer, and a tachometer. The liquid crystal display devices 571 are all covered with one exterior panel 572.

Each of the liquid crystal display devices 571 illustrated in FIG. 22 is configured by combining a liquid crystal panel 573 serving as liquid crystal display means and a movement mechanism serving as analog display means. The movement mechanism includes a motor serving as driving means and an indicator 574 rotated by the motor. As illustrated in FIG.

22, in the liquid crystal display device 571, a scale, a warning and the like can be displayed on a display surface of the liquid crystal panel 573, and the indicator 574 of the movement mechanism can be rotated on the display surface side of the liquid crystal panel 573. The display device 10 according to the embodiment is applied to the liquid crystal display device 571.

In FIG. 22, the liquid crystal display devices 571 are arranged in one exterior panel 572. However, the embodiment is not limited thereto. Alternatively, one liquid crystal display device may be provided in a region surrounded by the exterior panel to display a fuel gauge, a water-temperature gauge, a speedometer, a tachometer, and the like on the liquid crystal display device.

According to the embodiment, the present invention discloses the following display device, method for driving the display device, and electronic apparatus.

The present disclosure includes the following aspects.

(1) A display device including: an image display unit that includes a plurality of main pixels each including sub-pixels that are a red pixel, a green pixel, and a blue pixel in an image display region;

a light source that irradiates the image display region with illumination light;

a signal correction unit that calculates saturation and value of the main pixels based on first color information to be displayed on a predetermined pixel, the first color information being obtained based on an input video signal, and generates second color information by correcting the first color information based on the calculated saturation and value;

a signal generation unit that calculates the saturation and the value of the main pixels based on the second color information, and generates a signal for determining light source luminance of the light source based on the calculated saturation and value; and a light source control unit that controls luminance of the light source based on the light source luminance determined by the signal generation unit.

(2) The display device according to (1), wherein the signal correction unit reduces a correction amount when the value and the saturation of the first color information are higher than set reference values as compared with a case in which the saturation of the first color information is the same and the value thereof is lower than the set reference value.

(3) The display device according to (1), wherein the signal correction unit calculates the saturation and the value for each of the sub-pixels that are the red pixel, the green pixel, and the blue pixel in the image display unit, and corrects the first color information to the second color information based on the calculated saturation and value of each sub-pixel.

(4) The display device according to (1), wherein the main pixels further include a white pixel.

(5) The display device according to (1), wherein the light source is provided in plurality, the light source control unit dividedly drives the light sources, and the signal generation unit generates a signal for determining the light source luminance for each of the light sources.

(6) The display device according to (1), wherein the signal generation unit generates a signal obtained by reducing power consumption of the light source based on the value obtained by the following expression (1) and the saturation obtained by the following expression (2):

$$\text{value}=R\text{in}\times YR+G\text{in}\times YG+B\text{in}\times YB \qquad \text{expression (1)}$$

$$\text{saturation}=\text{MAX}(R\text{in},G\text{in},B\text{in})-\text{MIN}(R\text{in},G\text{in},B\text{in}) \qquad \text{expression (2)}$$

(in the expression (1) and the expression (2), Rin represents an input signal to the red pixel, Gin represents an input signal to the green pixel, Bin represents an input signal to the blue pixel, YR represents a value ratio of the red pixel, YG represents a value ratio of the green pixel, and YB represents a value ratio of the blue pixel).

(7) A method for driving a display device, the method including:

calculating saturation and value of a main pixel including sub-pixels that are a red pixel, a green pixel, and a blue pixel in an image display region based on first color information to be displayed on the main pixel, the first color information being obtained based on an input video signal;

generating second color information by correcting the first color information based on the saturation and the value calculated at the calculating;

determining light source luminance of a light source that irradiates the image display region with irradiation light based on the saturation and value of the main pixel calculated based on the second color information calculated at the generating; and controlling light source luminance of the light source to be the light source luminance determined at the determining.

(8) The method for driving a display device according to (7), wherein at the calculating, the saturation and the value are calculated for each of the sub-pixels that are the red pixel, the green pixel, and the blue pixel in the main pixel, and at the generating, the first color information is corrected to the second color information based on the saturation and the value of each sub-pixel calculated at the calculating.

(9) The method for driving a display device according to (7), wherein the main pixel further includes a white pixel.

(10) The method for driving a display device according to (7), wherein the light source is provided in plurality, and the light sources are dividedly driven.

(11) The method for driving a display device according to (7), wherein power consumption of the light source is reduced based on the value obtained by the following expression (1) and the saturation obtained by the following expression (2):

$$\text{value}=R\text{in}\times YR+G\text{in}\times YG+B\text{in}\times YB \qquad \text{expression (1)}$$

$$\text{saturation}=\text{MAX}(R\text{in},G\text{in},B\text{in})-\text{MIN}(R\text{in},G\text{in},B\text{in}) \qquad \text{expression (2)}$$

(in the expression (1) and the expression (2), Rin represents an input signal to the red pixel, Gin represents an input signal to the green pixel, Bin represents an input signal to the blue pixel, YR represents a value ratio of the red pixel, YG represents a value ratio of the green pixel, and YB represents a value ratio of the blue pixel).

(12) An electronic apparatus including:

a display device including:

an image display unit that includes a plurality of main pixels each including sub-pixels that are a red pixel, a green pixel, and a blue pixel in an image display region;

a light source that irradiates the image display region with illumination light;

a signal correction unit that calculates saturation and value of the main pixels based on first color information to be displayed on a predetermined pixel, the first color information being obtained based on an input video signal, and generates second color information by correcting the first color information based on the calculated saturation and value;

a signal generation unit that calculates the saturation and the value of the main pixels based on the second color information, and generates a signal for determining light source luminance of the light source based on the calculated saturation and value; and a light source control unit that controls luminance of the light source based on the light source luminance determined by the signal generation unit; and a controller that controls the controller.

According to the present invention, provided are a display device that can reduce the entire power consumption of the device by reducing light source luminance even when a high-saturation image is displayed, a method for driving the display device, and an electronic apparatus.

What is claimed is:

1. A display device comprising:

an image display unit in an image display region, the image display unit including a plurality of main pixels each including sub-pixels, wherein the sub-pixels include a red pixel, a green pixel, and a blue pixel;

a light source portion that irradiates the image display region with illumination light;

a signal correction unit that calculates saturation and value of the main pixels based on first color information to be displayed on a predetermined pixel, the first color information being obtained based on an input video signal, and generates second color information by correcting the first color information based on the calculated saturation and value;

a signal processing unit that calculates the saturation and the value of the main pixels based on the second color information, and generates a control signal for determining light source luminance of the light source based on the calculated saturation and value; and a light source control unit that controls luminance of the light source based on the control signal, wherein, in a case where each of the calculated saturation and value of the main pixels of the first color information is equal to or smaller than a predetermined threshold, the signal correction unit generates a light source luminance signal that reduces the light source luminance, and outputs the light source luminance signal to the signal generation unit, wherein the signal processing unit generates the control signal obtained by reducing power consumption of the light source portion based on the value obtained by the following expression (1) and the saturation obtained by the following expression (2):

$$\text{value}=R\text{in}\times YR+G\text{in}\times YG+B\text{in}\times YB \quad \text{expression (1)}$$

$$\text{saturation}=\text{MAX}(R\text{in},G\text{in},B\text{in})-\text{MIN}(R\text{in},G\text{in},B\text{in}) \quad \text{expression (2)}$$

wherein the signal processing unit calculates an output signal, the light source luminance of which is reduced, based on the following expression (3) to (6):

$$\text{reduction rate}=\text{maximum reduction rate}\times\text{saturation}\times(1/\text{value}) \quad \text{expression (3)}$$

$$R\text{out}=R\text{in}-R\text{in}\times\text{reduction rate} \quad \text{expression (4)}$$

$$G\text{out}=G\text{in}-G\text{in}\times\text{reduction rate} \quad \text{expression (5)}$$

$$B\text{out}=B\text{in}-B\text{in}\times\text{reduction rate} \quad \text{expression (6)}$$

wherein in the expression (1) and the expression (2), Rin represents an input signal to the red pixel, Gin represents an input signal to the green pixel, Bin represents an input signal to the blue pixel, YR represents a value ratio of the red pixel, YG represents a value ratio of the green pixel, and YB represents a value ratio of the blue pixel.

2. The display device according to claim 1, wherein the signal correction unit increases a correction amount when the value and the saturation of the first color information are lower than reference values when the saturation of the first color information is the same and the value thereof is higher than the reference value, and the correction amount is a corrected amount from the first color information to the second color information.

3. The display device according to claim 1, wherein the signal correction unit calculates the saturation and the value for each of the sub-pixels in the image display unit, and corrects the first color information to the second color information based on the calculated saturation and value of each sub-pixel.

4. The display device according to claim 1, wherein the main pixels further include a white pixel as a sub-pixel.

5. The display device according to claim 1, wherein the light source portion includes a plurality of light sources, the light source control unit dividedly drives the plurality of light sources, and the signal processing unit generates the control signal for determining the light source luminance for each of the plurality of light sources.

6. A method for driving a display device, the method comprising:

calculating saturation and value of a main pixel in an image display region based on first color information to be displayed on the main pixel, the first color information being obtained based on an input video signal, wherein the main pixel includes sub-pixels, wherein the sub-pixels include a red pixel, a green pixel, and a blue pixel;

generating second color information by correcting the first color information based on the saturation and the value calculated at the calculating;

determining light source luminance of a light source portion that irradiates the image display region with irradiation light based on the saturation and value of the main pixel calculated based on the second color information calculated at the generating;

controlling light source luminance of the light source portion to be the light source luminance determined at the determining; and at the determining, in a case where each of the calculated saturation and value of the main pixels of the first color information is equal to or smaller than a predetermined threshold, reducing the light source luminance, wherein power consumption of the light source portion is reduced based on the value obtained by the following expression (1) and the saturation obtained by the following expression (2):

$$\text{value}=R\text{in}\times YR+G\text{in}\times YG+B\text{in}\times YB \quad \text{expression (1)}$$

$$\text{saturation}=\text{MAX}(R\text{in},G\text{in},B\text{in})-\text{MIN}(R\text{in},G\text{in},B\text{in}) \quad \text{expression (2)}$$

wherein calculating an output signal, the light source luminance of which is reduced, is based on the following expressions (3) to (6):

$$\text{reduction rate}=\text{maximum reduction rate}\times\text{saturation}\times(1/\text{value}) \quad \text{expression (3)}$$

$$R\text{out}=R\text{in}-R\text{in}\times\text{reduction rate} \quad \text{expression (4)}$$

$$G\text{out}=G\text{in}-G\text{in}\times\text{reduction rate} \quad \text{expression (5)}$$

$$B\text{out}=B\text{in}-B\text{in}\times\text{reduction rate} \quad \text{expression (6)}$$

wherein in the expression (1) and the expression (2), Rin represents an input signal to the red pixel, Gin represents an input signal to the green pixel, Bin represents an input signal to the blue pixel, YR represents a value ratio of the red pixel, YG represents a value ratio of the green pixel, and YB represents a value ratio of the blue pixel.

7. The method for driving a display device according to claim 6, wherein the saturation and the value are calculated for each of the sub-pixels at the calculating, and the first color information is corrected to the second color information based on the calculated saturation and the value of each sub-pixel at the generating.

8. The method for driving a display device according to claim 6, wherein the main pixel further includes a white pixel as a sub-pixel.

9. The method for driving a display device according to claim 6, wherein the light source portion includes a plurality of light sources, and the plurality of light sources are dividedly driven.

10. The display device according to claim 1, wherein the signal correction unit generates the light source luminance signal that reduces the light source luminance based on only the saturation and value of the main pixels of the first color information.

11. The method for driving a display device according to claim 6, wherein at the determining, reducing the light source luminance is based only the saturation and value of the main pixels of the first color information.

* * * * *